US012123163B2

(12) United States Patent
Vahling et al.

(10) Patent No.: US 12,123,163 B2
(45) **Date of Patent: *Oct. 22, 2024**

(54) MOUNTING ASSEMBLY

(71) Applicant: Caterpillar Inc., Peoria, IL (US)

(72) Inventors: Bruce Raymond Vahling, Urbana, IL (US); David L. Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 897 days.

This patent is subject to a terminal disclaimer.

(21) Appl. No.: 17/114,014

(22) Filed: Dec. 7, 2020

(65) Prior Publication Data

US 2021/0087781 A1 Mar. 25, 2021

Related U.S. Application Data

(63) Continuation of application No. 16/276,733, filed on Feb. 15, 2019, now Pat. No. 10,889,960.

(51) Int. Cl.
*E02F 3/815* (2006.01)
*E02F 3/76* (2006.01)

(52) U.S. Cl.
CPC ..... *E02F 3/8152* (2013.01); *E02F 3/764* (2013.01); *E02F 3/815* (2013.01); *E02F 3/8157* (2013.01); *E02F 3/7645* (2013.01); *E02F 3/765* (2013.01)

(58) Field of Classification Search
CPC ..... E02F 3/8152; E02F 3/815; E02F 3/7645; E02F 3/764; E02F 3/8157; E02F 3/765; F16C 29/084
See application file for complete search history.

(56) References Cited

U.S. PATENT DOCUMENTS

| | | | | |
|---|---|---|---|---|
| 4,037,670 | A * | 7/1977 | Atherton | E02F 3/764 172/476 |
| 4,058,174 | A * | 11/1977 | Atherton | E02F 3/764 172/741 |
| 4,074,767 | A * | 2/1978 | Cole | E02F 3/764 172/741 |
| 4,084,643 | A * | 4/1978 | Easterling | E02F 3/815 172/795 |
| 7,371,009 | B1 * | 5/2008 | Burgess | F16C 29/02 384/42 |
| 9,809,950 | B2 * | 11/2017 | Zimmerman | E02F 3/7636 |
| 11,041,286 | B2 * | 6/2021 | Harshman | E02F 3/815 |

* cited by examiner

*Primary Examiner* — Jessica H Lutz

(57) ABSTRACT

A wear element for a mounting system for a blade of a motor grader is provided. The wear element extends along a longitudinal axis. The wear element includes a first portion having a first cross-sectional area transverse to the longitudinal axis. The wear element further includes a second portion opposite of the first portion, the second portion having a second cross-sectional area having a V-shape that extends away from the first portion.

15 Claims, 7 Drawing Sheets

SECTION A–A'

SECTION A–A'

SECTION B–B'

MOUNTING ASSEMBLY

CROSS-REFERENCE TO RELATED APPLICATION

This application is a continuation of U.S. patent application Ser. No. 16/276,733 filed Feb. 15, 2019, which is incorporated by reference herein in its entirety.

TECHNICAL FIELD

The present disclosure relates to a mounting assembly. More particularly, the present disclosure relates to a mounting assembly for a blade of a motor grader.

BACKGROUND

Grader machines, often referred to as motor graders, are typically used to displace, distribute, mix, and grade a material, such as soil, over a work surface. Grader machines commonly employ a blade or moldboard to carry out one or more of these functions. Some machines may provide for lateral movement of the blade, thereby allowing the blade to assume various work-related positions relative to the work surface.

Commonly, a wear strip is employed between a mounting member and the blade for the blade to slide against. As the wear strip may wear out, a new wear strip may have to be provided between the mounting member and the blade. However, replacement of the wear strip may be a laborious and time intensive process due to complex mounting arrangements around the wear strip. Additionally, multidirectional adjustment may be required between the mounting member and the blade, in turn, increasing labor effort and skill. Hence, there is a need for an improved mounting assembly for such applications.

U.S. Pat. No. 9,809,950 describes a moldboard rail cleaner for removing debris from a rail of a work machine. The work machine includes a tilt frame housing defining a first cavity. The work machine includes a wear insert positioned within the first cavity and adapted to slide along the rail as the rail moves along a rail axis. Further, a sub-housing may be coupled to the tilt frame housing and defines a second cavity. Finally, a wiper is disposed at least partially within the second cavity, such that the sub-housing is adapted to bias the wiper into contact with the rail.

SUMMARY OF THE DISCLOSURE

In an aspect of the present disclosure, a wear element for a mounting system for a motor grader is provided. The wear element extends along a longitudinal axis. The wear element includes a first portion having a first cross-sectional area transverse to the longitudinal axis. The wear element further includes a second portion opposite of the first portion, the second portion having a second cross-sectional area having a V-shape that extends away from the first portion.

In another aspect of the present disclosure, a method of installing a wear element into a mounting system is provided. The method includes sliding a first portion of the wear element along a longitudinal axis into a mounting groove of an adjustment block, the first portion having a dovetail shape cross sectional area. The method further includes engaging a second portion of the wear element with a mounting grove, the second portion being disposed opposite of the first portion and having a V-shaped cross sectional area. A retention screw is adjusted in a bore of the adjustment block to limit movement of the wear element along the longitudinal axis.

In yet another aspect of the present disclosure, a mounting system for a blade of a motor grader is provided. The mounting system includes an adjustment block having a mounting groove extending along a longitudinal axis of the adjustment block and a mounting bracket attachment point spaced apart with respect to the mounting groove. The mounting bracket attachment point is configured to attach to a mounting bracket. The mounting system further includes a wear element configured to engage with the mounting groove of the adjustment block and slidably receive a portion of the blade.

Other features and aspects of this disclosure will be apparent from the following description and the accompanying drawings.

DETAILED DESCRIPTION

Figure 1:
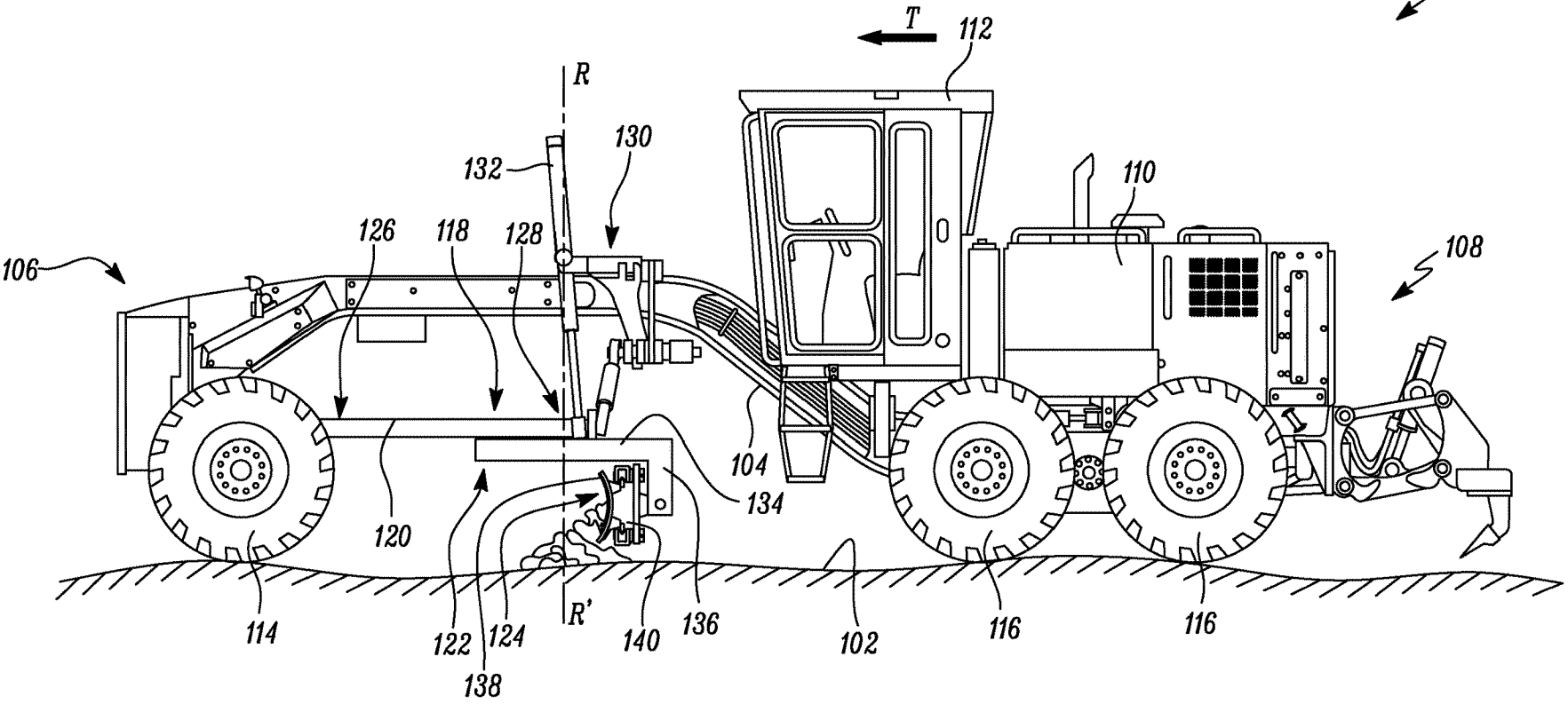
FIG. 1 is a side view of an exemplary motor grader, according to one embodiment of the present disclosure.

Wherever possible, the same reference numbers will be used throughout the drawings to refer to the same or the like parts. Referring to FIG. 1, a side view of an exemplary motor grader 100 is illustrated. The motor grader 100 may be used to displace, spread, distribute, level, and/or grade materials, such as soil, over a work surface 102 during a grading operation. The motor grader 100 includes a frame 104. The frame 104 defines a front end 106 and a rear end 108 with respect to a direction of travel "T" of the motor grader 100. The frame 104 supports one or more components of the motor grader 100. The motor grader 100 includes an enclosure 110 mounted on the frame 104. The enclosure 110 houses a power source (not shown), such as an engine, batteries, and the like, of the motor grader 100. The power source provides power to the motor grader 100 for operational and mobility requirements.

The motor grader 100 includes an operator cabin 112 mounted on the frame 104. The operator cabin 112 includes various controls (not shown), such as a steering, a joystick, an operator console, an operator seat, levers, pedals, buttons, switches, knobs, and the like. The controls are adapted to control the motor grader 100 on the work surface 102. The motor grader 100 includes a set of front wheels 114 and a set of rear wheels 116 rotatably mounted to the frame 104. Each of the front wheels 114 and the rear wheels 116 support and provide mobility to the motor grader 100 on the work surface 102.

The motor grader 100 includes a grader group 118 movably mounted to the frame 104. The grader group 118 is adapted to level and grade material over the work surface 102 during the grading operation. The grader group 118 includes a drawbar 120, a circle assembly 122, and a blade assembly 124. The drawbar 120 includes a first end 126 pivotally coupled to the front end 106 of the frame 104. The drawbar 120 includes a second end 128 movably coupled to a mid-portion 130 of the frame 104 via one or more actuators 132, such as a hydraulic actuator. The actuator 132 may be actuated to raise or lower the second end 128 of the drawbar 120 with respect to the frame 104, in turn, allowing the grader group 118 to be raised or lowered with respect to the work surface 102.

The circle assembly 122 includes a circle member 134 and an arm 136. The circle member 134 rotates with respect to the drawbar 120 about a rotation axis R-R' of the circle member 134. The arm 136 extends from the circle member 134 and rotates with a rotation of the circle member 134 with respect to the drawbar 120. The arm 136 extends from the circle member 134 in an axial direction along the rotation axis R-R'. In the illustrated embodiment, the circle assembly 122 includes a single arm 136. In other embodiments, the circle assembly 122 may include multiple arms, such that each of the multiple arms may be disposed spaced apart with respect to one another on the circle member 134.

Figure 2:
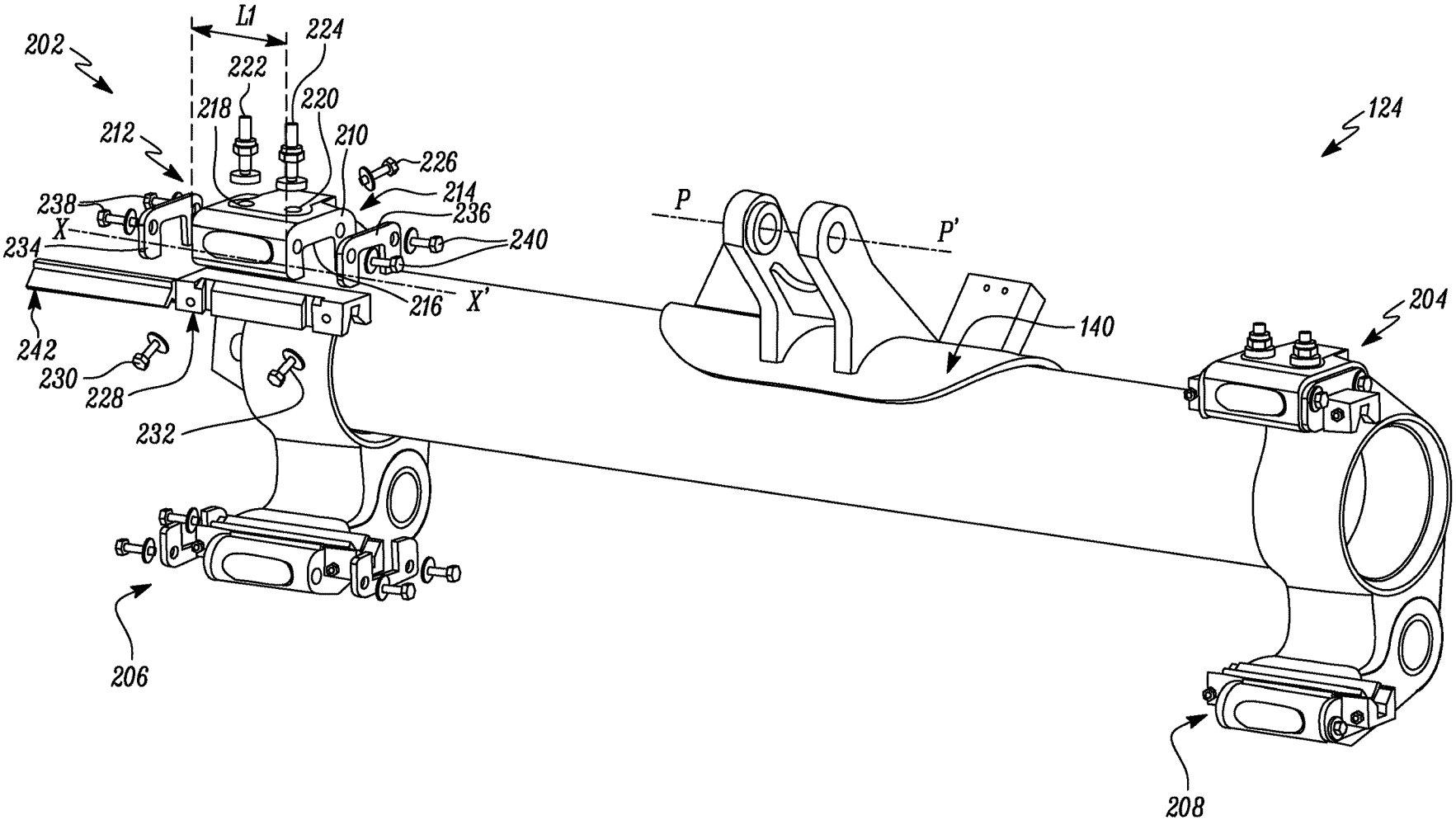
FIG. 2 is an exploded perspective view of a mounting assembly of a blade assembly of the motor grader of FIG. 1, according to one embodiment of the present disclosure.

Referring to FIGS. 1 and 2, the blade assembly 124 includes a blade 138, a support member 140, and a number of mounting assemblies, such as first mounting assemblies 202, 204 and second mounting assemblies 206, 208. In the accompanying figure, two first mounting assemblies 202, 204 and two second mounting assemblies 206, 208 are shown. It should be noted that, in other embodiments, the blade assembly 124 may include single or multiple first mounting assemblies and/or single or multiple second mounting assemblies, based on application requirements. The blade assembly 124 is mounted to the arm 136 via the support member 140. The support member 140 is movably coupled to the arm 136, such that the support member 140 pivots about a pivot axis P-P' with respect to the frame 104.

The blade 138 is mounted to the support member 140 via each of the first mounting assemblies 202, 204 and each of the second mounting assemblies 206, 208. As such, the blade 138 pivots about the pivot axis P-P' with respect to the frame 104. Also, the blade 138 slides substantially parallel to the pivot axis P-P' with respect to each of the first mounting assemblies 202, 204 and each of the second mounting assemblies 206, 208. The blade 138 engages the work surface 102 during the grading operation. For purpose of clarity and explanation, the mounting assembly will now be explained with reference to the first mounting assembly 202. It should be noted that each of the first mounting assembly 204 and the second mounting assemblies 206, 208 has a configuration similar to a configuration of the first mounting assembly 202.

The first mounting assembly 202 includes a mounting bracket 210. The mounting bracket 210 is mounted to the support member 140. In the illustrated embodiment, the mounting bracket 210 is integrally manufactured with the support member 140. In other embodiments, the mounting bracket 210 may be a separate component with respect to the support member 140. In such a situation, the mounting bracket 210 may be coupled to support member 140 using any coupling method, such as bolting, welding, clamping, and the like.

In the illustrated embodiment, the mounting bracket 210 has a substantially C-shaped configuration. Accordingly, the mounting bracket 210 defines a bracket longitudinal axis X-X' and a bracket length "L1". In other embodiments, the mounting bracket 210 may have any other configuration, such as a curved configuration, a V-shaped configuration, and the like. The bracket longitudinal axis X-X' is disposed substantially parallel and spaced apart with respect to the pivot axis P-P'. The mounting bracket 210 includes a first side 212 and a second side 214. The second side 214 is disposed opposite and spaced apart with respect to the first side 212 along the bracket longitudinal axis X-X'.

The mounting bracket 210 includes a mounting channel 216. In the illustrated embodiment, the mounting channel 216 has a substantially C-shaped configuration. In other embodiments, the mounting channel 216 may have any other configuration, such as a V-shaped configuration, a curved configuration, and the like. The mounting channel 216 extends along the bracket longitudinal axis X-X' between the first side 212 and the second side 214. The mounting bracket 210 may be manufactured using any process, such as casting, forging, fabrication, additive manufacturing, and the like. Also, the mounting bracket 210 may be manufactured using any material, such as a metal, an alloy, and the like.

The mounting bracket 210 also includes a number of first holes 218, 220. In the illustrated embodiment, the mounting bracket 210 includes two first holes 218, 220. In other embodiments, the mounting bracket 210 may include single or multiple first holes, based on application requirements. Each of the first holes 218, 220 is disposed spaced apart with respect to one another along the bracket longitudinal axis X-X'. Also, each of the first holes 218, 220 is disposed substantially perpendicularly with respect to the bracket longitudinal axis X-X'. Each of the first holes 218, 220 is provided in association with the mounting channel 216. More specifically, each of the first holes 218, 220 intersects the mounting channel 216. Each of the first holes 218, 220 is adapted to receive a first set screw 222, 224, respectively. The first set screws 222, 224 will be explained in more detail later.

Figure 6:
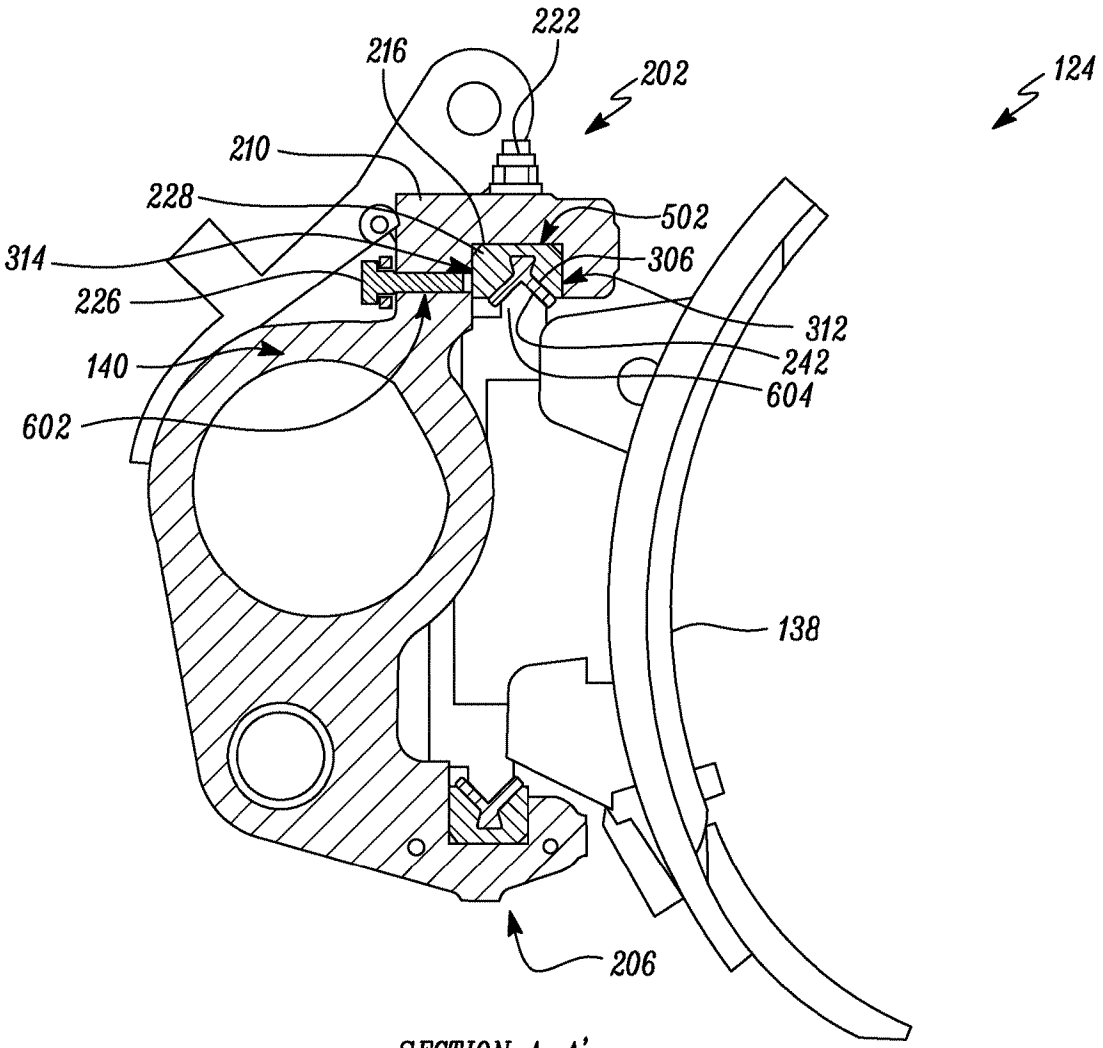
FIG. 6 is a partial cross-sectional view of the mounting assembly of FIG. 5 along a section A-A', according to one embodiment of the present disclosure.

The mounting bracket 210 also includes a second hole 602 (shown in FIG. 6). In the illustrated embodiment, the mounting bracket 210 includes a single second hole 602. In other embodiments, the mounting bracket 210 may include multiple second holes, based on application requirements. The second hole 602 is disposed spaced apart with respect to each of the first holes 218, 220. Also, the second hole 602 is disposed substantially perpendicularly with respect to each of the bracket longitudinal axis X-X' and each of the first holes 218, 220. The second hole 602 is provided in association with the mounting channel 216. More specifically, the second hole 602 intersects the mounting channel 216. The second hole 602 is adapted to receive a second set screw 226. The second set screw 226 will be explained in more detail later.

Figure 3:
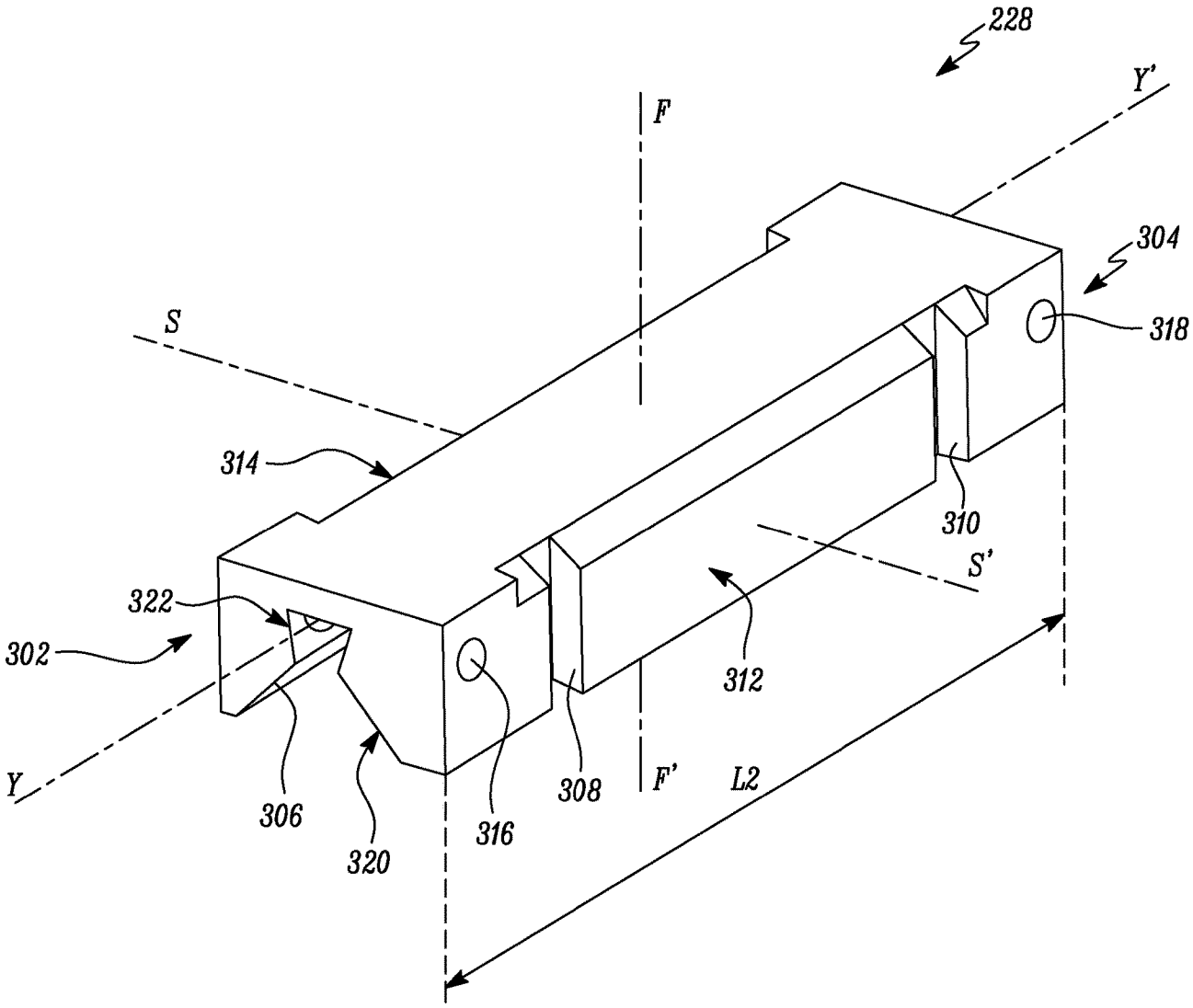
FIG. 3 is a perspective view of an adjustment block of the mounting assembly of FIG. 2, according to one embodiment of the present disclosure.

Referring to FIGS. 2 and 3, the first mounting assembly 202 also includes an adjustment block 228. The adjustment block 228 is adapted to be disposed in the mounting channel 216. In the illustrated embodiment, the adjustment block 228 has a substantially elongated and rectangular configuration. Accordingly, the adjustment block 228 defines a block longitudinal axis Y-Y' and a block length "L2". The block longitudinal axis Y-Y' is disposed substantially parallel and spaced apart with respect to each of the bracket longitudinal axis X-X' and the pivot axis P-P'.

Also, the block length "L2" is substantially greater than the bracket length "L1". In other embodiments, the adjustment block 228 may have any other configuration, such as a curved configuration, a V-shaped configuration, and the like. The adjustment block 228 includes a first end 302 and a second end 304. The second end 304 is disposed opposite and spaced apart with respect to the first end 302 along the block longitudinal axis Y-Y'. The adjustment block 228 also includes a mounting groove 306. The mounting groove 306 extends substantially along the block longitudinal axis Y-Y' between the first end 302 and the second end 304.

In the illustrated embodiment, the mounting groove 306 has a partial V-shaped configuration 320 and a partial dovetail-shaped configuration 322. In other embodiments, the mounting groove 306 may have any other configuration, such as a full V-shaped configuration, a partial V-shaped configuration with a partial T-shaped configuration, and the like or any other combination, based on application requirements.

The adjustment block 228 also includes a number of slots, such as a first slot 308, a second slot 310, a third slot (not shown), and a fourth slot (not shown). In the illustrated embodiment, the adjustment block 228 includes four slots. In other embodiments, the adjustment block 228 may include single or multiple slots, based on application requirements. Each of the first slot 308 and the second slot 310 is disposed on a first outer surface 312 of the adjustment block 228. Each of the third slot and the fourth slot is disposed on a second outer surface 314 of the adjustment block 228. The second outer surface 314 is disposed opposite to the first outer surface 312 with respect to the block longitudinal axis Y-Y'.

The first slot 308 is disposed opposite the third slot, such that each of the first slot 308 and the third slot is disposed adjacent to the first end 302 of the adjustment block 228. The second slot 310 is disposed opposite the fourth slot, such that each of the second slot 310 and the fourth slot is disposed adjacent to the second end 304 of the adjustment block 228. Further, each of the first slot 308, the second slot 310, the third slot, and the fourth slot is disposed spaced apart with respect to one another and the mounting groove 306. More specifically, each of the first slot 308, the second slot 310, the third slot, and the fourth slot extends substantially parallel with respect to a first lateral axis F-F' of the adjustment block 228, such that the first lateral axis F-F' is substantially perpendicular with respect to the block longitudinal axis Y-Y'.

The adjustment block 228 further includes a first bore 316 and a second bore 318. Each of the first bore 316 and the second bore 318 is disposed substantially parallel with respect to a second lateral axis S-S' of the adjustment block 228. The second lateral axis S-S' is disposed substantially perpendicular with respect to each of the block longitudinal axis Y-Y' and the first lateral axis F-F'. Each of the first bore 316 and the second bore 318 is disposed adjacent to and in association with the mounting groove 306. More specifically, the first bore 316 is disposed adjacent to the first end 302 and intersects the mounting groove 306. Also, the second bore 318 is disposed adjacent to the second end 304 and intersects the mounting groove 306. Each of the first bore 316 and the second bore 318 is adapted to receive a first retention screw 230 and a second retention screw 232, respectively. Each of the first retention screw 230 and the second retention screw 232 will be explained in more detail later.

Referring to FIG. 2, the first mounting assembly 202 also includes a number of retention plates, such as a first retention plate 234 and a second retention plate 236. In the illustrated embodiment, the first mounting assembly 202 includes two retention plates. In other embodiments, the first mounting assembly 202 may include a single retention plate, based on application requirements. Each of the first retention plate 234 and the second retention plate 236 has a substantially C-shaped configuration.

Each of the first retention plate 234 and the second retention plate 236 is adapted to be disposed on the mounting bracket 210 in association with the adjustment block 228. More specifically, the first retention plate 234 is adapted to be disposed on the first side 212 of the mounting bracket 210. Accordingly, the first retention plate 234 is adapted to engage with each of the first slot 308 and the third slot of the adjustment block 228. Also, the second retention plate 236 is adapted to be disposed on the second side 214 of the mounting bracket 210. Accordingly, the second retention plate 236 is adapted to engage with each of the second slot 310 and the fourth slot of the adjustment block 228.

The first retention plate 234 is adapted to be removably coupled to the first side 212 of the mounting bracket 210 using one or more first fasteners 238. The second retention plate 236 is adapted to be removably coupled to the second side 214 of the mounting bracket 210 using one or more second fasteners 240. Each of the first fasteners 238 and the second fasteners 240 may be any fastener, such as a bolt, a screw, and the like. Each of the first retention plate 234 and the second retention plate 236 is adapted to limit movement of the adjustment block 228 along the bracket longitudinal axis X-X' and will be explained in more detail later.

Figure 4:
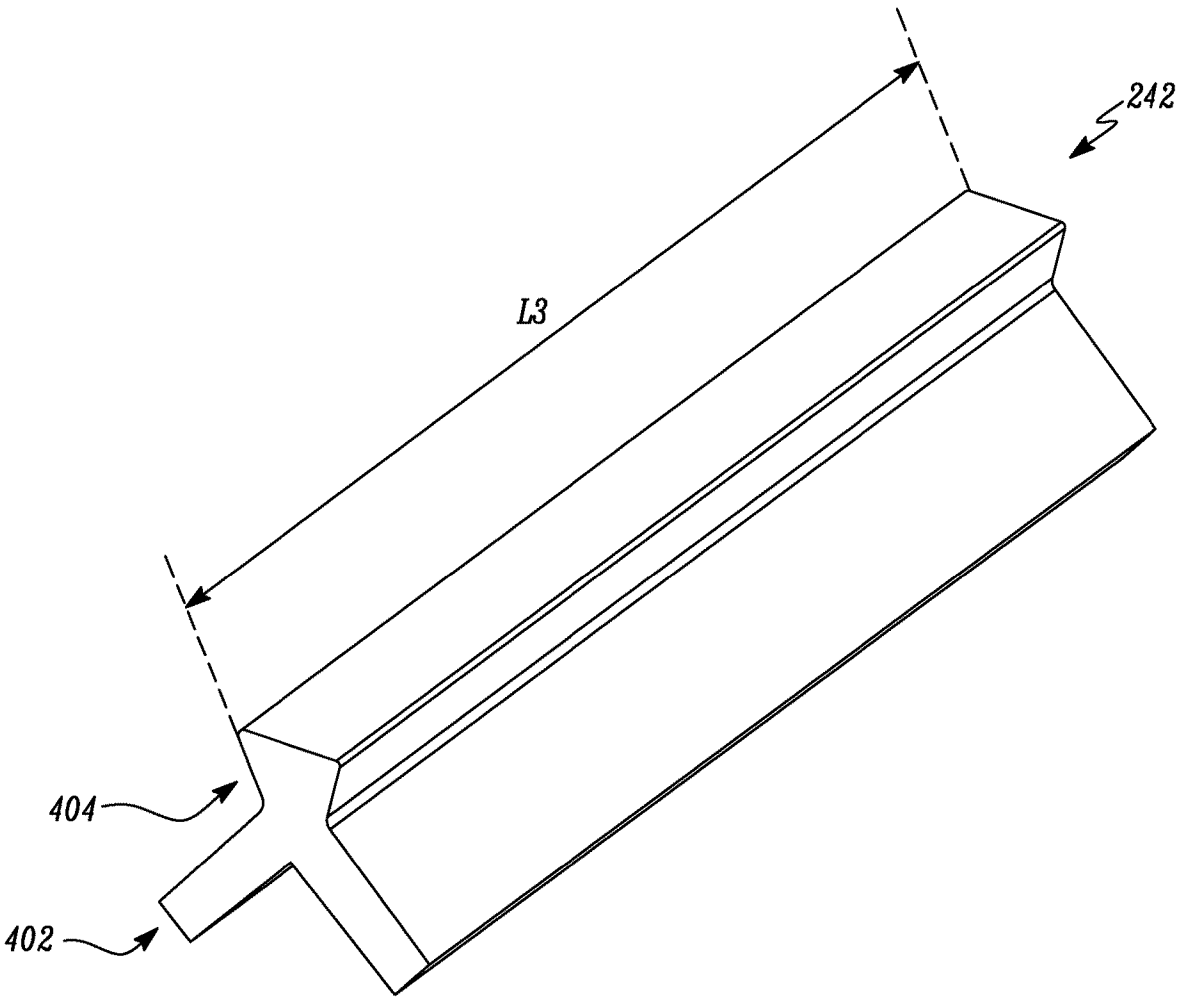
FIG. 4 is a perspective view of a wear element of the mounting assembly of FIG. 2, according to one embodiment of the present disclosure.

Referring to FIGS. 2 and 4, the first mounting assembly 202 further includes a wear element 242. The wear element 242 is adapted to be disposed in the mounting groove 306 provided in the adjustment block 228. The wear element 242 has a configuration substantially similar to a configuration of the mounting groove 306. As such, the wear element 242 has a substantially elongated configuration defining an element length "L3". In the illustrated embodiment, the element length "L3" is substantially greater than the bracket length "L1" and smaller than the block length "L2". In other embodiments, a relative value of the element length "L3" may vary with respect to each of the bracket length "L1" and the block length "L2".

More specifically, in the illustrated embodiment, based on the configuration of the mounting groove 306, the wear element 242 has a partial V-shaped configuration 402 and a partial dovetail-shaped configuration 404. In other embodiments, the wear element 242 may have any other configuration, such as a full V-shaped configuration, a partial V-shaped configuration with a partial T-shaped configuration, and the like or any other combination, based on application requirements.

The wear element 242 is adapted to slidably receive a portion of the blade 138, such as a mounting rail 604 (shown in FIG. 6) of the blade 138. More specifically, the wear element 242 is adapted to provide a sacrificial wear surface between the mounting rail 604 of the blade 138 and the adjustment block 228. Also, the mounting rail 604 limits lateral movement of the wear element 242 and the adjustment block 228 out of the mounting channel 216 along the first lateral axis F-F'. The wear element 242 may be manufactured using any material, such as a metal, an alloy, a polymer, and the like. For example, in one embodiment, the wear element 242 may be made of the metal, such as aluminum. In another embodiment, the wear element 242 may be made of the alloy, such as such as steel, a bronze magnesium alloy, a copper alloy, and the like. The wear element 242 may be manufactured using any manufacturing process, such as casting, forging, machining, additive manufacturing, and the like.

INDUSTRIAL APPLICABILITY

Figure 5:
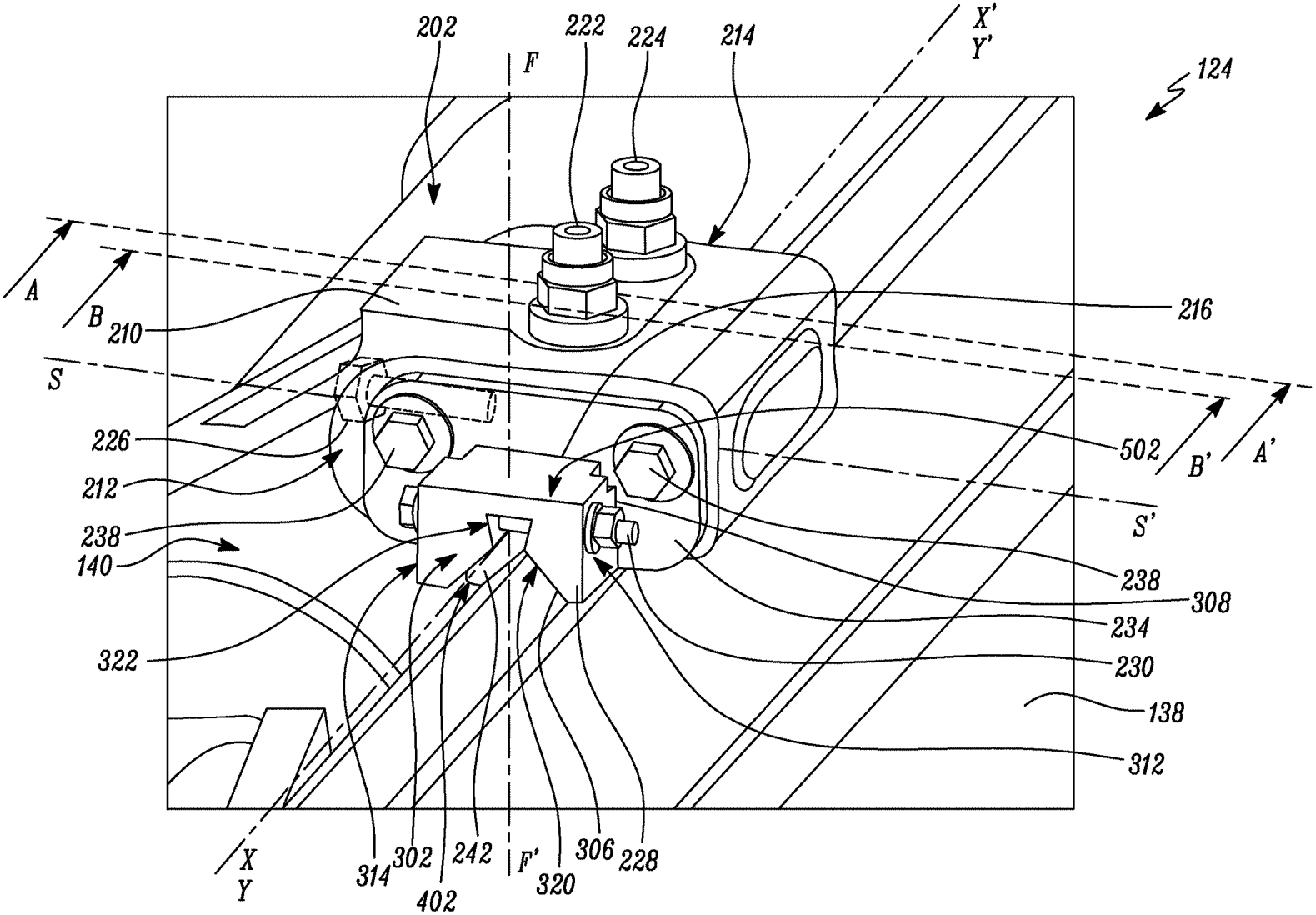
FIG. 5 is a perspective view of the mounting assembly of FIG. 2 in an assembled position, according to one embodiment of the present disclosure.

The present disclosure relates to the mounting assembly for the blade 138 of the motor grader 100. Referring to FIG. 5, an assembled position of the first mounting assembly 202 is illustrated. During assembly, the mounting bracket 210 is provided on the support member 140. Each of the first retention plate 234 and the second retention plate 236 is then disposed on the mounting bracket 210. More specifically, the first retention plate 234 is coupled to the first side 212 of the mounting bracket 210 using the first fasteners 238. Also, the second retention plate 236 is coupled to the second side 214 of the mounting bracket 210 using the second fasteners 240.

The adjustment block 228 is then disposed in the mounting channel 216 of the mounting bracket 210. More specifically, the adjustment block 228 is slid along the first lateral axis F-F' into the mounting channel 216, such that the first retention plate 234 engages with each of the first slot 308 and the third slot, and the second retention plate 236 engages with each of the second slot 310 and the fourth slot. In the assembled position, the bracket longitudinal axis X-X' coincides with the block longitudinal axis Y-Y'.

Referring to FIGS. 5 and 6, the second set screw 226 is then disposed in the second hole 602 of the mounting bracket 210. The second set screw 226 is tightened into the second hole 602, such that the second set screw 226 operably engages with the second outer surface 314 of the adjustment block 228. As such, the second set screw 226 holds the adjustment block 228 in the mounting channel 216 of the mounting bracket 210 by friction and limits slipping of the adjustment block 228 out of the mounting channel 216 during assembly.

Referring to FIG. 5, the wear element 242 is then disposed in the mounting groove 306 of the adjustment block 228. More specifically, the wear element 242 is slid along the block longitudinal axis Y-Y' in the mounting groove 306, such that the dovetail configuration 322, 404 of each of the mounting groove 306 and the wear element 242 engage with respect to one another, respectively, and the V-shaped configuration 320, 402 of each of the mounting groove 306 and the wear element 242 engage with respect to one another, respectively. Further, the first retention screw 230 and the second retention screw 232 is disposed in the first bore 316 and the second bore 318 of the adjustment block 228, respectively. As such, each of first retention screw 230 and the second retention screw 232 limits movement of the wear element 242 along the block longitudinal axis Y-Y' within the mounting groove 306 of the adjustment block 228.

Further, the mounting rail 604 of the blade 138 is slidably disposed on the V-shaped configuration 402 of the wear element 242. As such, the mounting rail 604 holds the wear element 242 and the adjustment block 228 in the mounting channel 216 of the mounting bracket 210 and prevents slipping of the adjustment block 228 out of the mounting bracket 210 along the first lateral axis F-F'. In some situations, the second set screw 226 may be loosened prior to operation of the motor grader 100. As such, the second set screw 226 may operably disengage with respect to the second outer surface 314 of the adjustment block 228.

Figure 7:
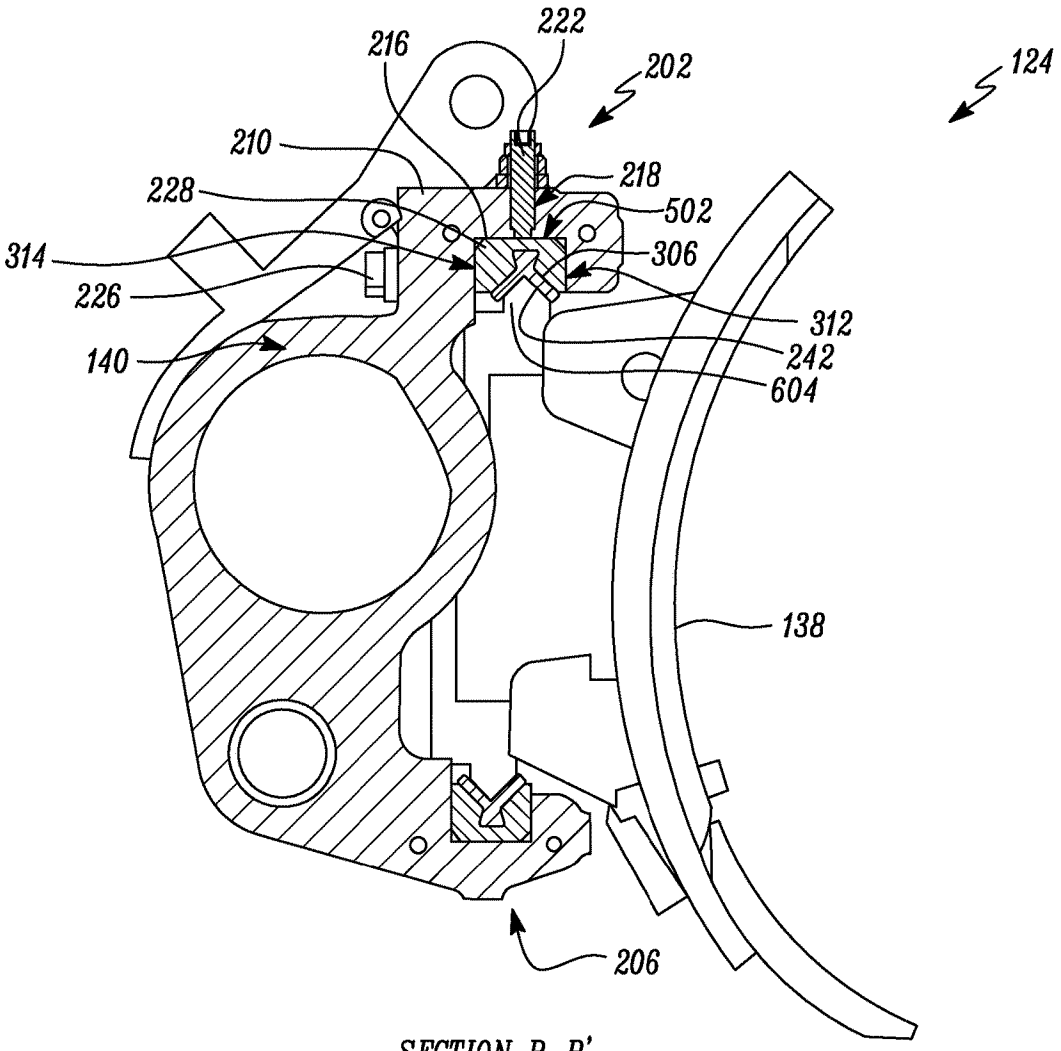
FIG. 7 is a partial cross-sectional view of the mounting assembly of FIG. 5 along a section B-B', according to one embodiment of the present disclosure.

Referring to FIGS. 5 and 7, additionally, each of the first set screws 222, 224 is disposed in each of the first holes 218, 220 of the mounting bracket 210, respectively. Each of the first set screws 222, 224 is then tightened into each of the first holes 218, 220, respectively, such that each of the first set screws 222, 224 operably engage with a third outer surface 502 of the adjustment block 228. As such, each of the first set screws 222, 224 adjusts the adjustment block 228 along the first lateral axis F-F'. Accordingly, based on a level of tightening, each of the first set screws 222, 224 limits operational clearance between the mounting bracket 210, the adjustment block 228, the wear element 242, and/or the mounting rail 604.

During disassembly or replacement of the wear element 242, each of the first set screws 222, 224 and the second set screw 226 is loosened within each of the first holes 218, 220 and the second hole 602, respectively. As such, each of the first set screws 222, 224 and the second set screw 226 is operably disengaged with respect to the adjustment block 228. Accordingly, the adjustment block 228 may now be able to move with respect to the mounting bracket 210 due to the operational clearance between the mounting bracket 210, the adjustment block 228, the wear element 242, and/or the mounting rail 604. Each of the first retention screw 230 and the second retention screw 232 is then removed from each of the first bore 316 and the second bore 318 of the adjustment block 228, respectively. The wear element 242 is then slid out of the mounting groove 306 of the adjustment block 228 along the block longitudinal axis Y-Y'.

In some situations, each of the first retention plate 234 and the second retention plate 236 may be disassembled from each of the first side 212 and the second side 214 of the mounting bracket 210, respectively. More specifically, each of the first fasteners 238 and the second fasteners 240 may be decoupled in order to decouple each of the first retention plate 234 and the second retention plate 236. Each of the first retention plate 234 and the second retention plate 236 is then slid along the first lateral axis F-F' in order to disengage each of the first retention plate 234 and the second retention plate 236 with respect to the adjustment block 228.

The adjustment block 228 may then be disassembled with respect to the mounting bracket 210. More specifically, the adjustment block 228 may be slid along the bracket longitudinal axis X-X' and/or the first lateral axis F-F' in order to disassemble the adjustment block 228 with respect to the mounting bracket 210. A new wear element 242 may then be replaced in the mounting groove 306 of the adjustment block 228 and further in the mounting bracket 210 in a manner as described above with reference to assembly of the wear element 242 on the mounting bracket 210. It should be noted that a process/sequence of assembly/disassembly of the mounting assembly described herein is merely exemplary and may vary, based on application requirements.

The first mounting assembly 202 provides a simple, efficient, and cost-effective method of mounting the blade 138 on the frame 104 of the motor grader 100 with the wear element 242. Each of the wear element 242 and the mounting groove 306 of the adjustment block 228 includes the partial dovetail-shaped configuration 322, 404, respectively. As such, the dovetail shaped configuration 322, 404 provides ease of assembly and retention of the wear element 242 within the mounting groove 306 without use of any additional retention elements. Also, the V-shaped configuration 402 of the wear element 242 provides automatic alignment of the mounting rail 604 of the blade 138 on the wear element 242, in turn, providing ease of assembly and reduced alignment effort.

Further, each of the first set screws 222, 224 provides simplified adjustment of the operational clearance between various components of the first mounting assembly 202. As such, relative movement between various components of the first mounting assembly 202 may be limited, in turn, limiting premature wear and tear of the components of the first mounting assembly 202. Also, the second set screw 226 allows holding of the adjustment block 228 within the mounting channel 216 during assembly, in turn, providing ease of assembly and reduced labor effort.

The wear element 242 may be assembled and/or disassembled from the adjustment block 228, as and when required, using commonly available tools and/or without complete disassembly of the blade assembly 124. The wear element 242 has the element length "L3" substantially greater than the bracket length "L1", in turn, providing a substantially increased wear surface area and, thus, improved product life. As such, the first mounting assembly 202 reduces service intervals, reduces service time, reduces labor effort, reduces machine downtime, improves productivity, and improves overall costs.

The first mounting assembly 202 employs known and readily available components, such as the first and second retention screws 230, 232, the first set screws 222, 224, the second set screw 226, and the like, in turn, reducing complexity and improving compatibility. The first mounting assembly 202 provides improved visibility of the wear element 242 from each of the first end 302 and the second end 304 of the adjustment block 228, in turn, providing ease of inspection. The first mounting assembly 202 also provides improved working clearance around the blade assembly 124, in turn, improving access and serviceability. The first mounting assembly 202 may be retrofitted on any motor grader 100 with little or no modification to the existing system, in turn, improving product compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. A wear element for a mounting system for a motor grader, the wear element extending along a longitudinal axis and comprising:

a first portion having a first cross-sectional area transverse to the longitudinal axis, wherein the first cross-sectional area comprises a dovetail shape; and a second portion opposite of the first portion, the second portion having a second cross-sectional area having a V-shape that extends away from the first portion, the V-shape having a width at a distal end wider than the first portion, wherein the dovetail shape has a maximum width at a point distal from the second portion, and wherein the dovetail shape and the V-shape extend along an entire length of the wear element.

2. The wear element of claim 1, wherein in the first portion comprises a protruded portion that extends away from the second portion, the protruded portion having a maximum width at a point distal from the second portion.

3. The wear element of claim 1, wherein in a shape of the first cross-sectional area corresponds to engage with a shape of a mounting groove on an adjustment block.

4. The wear element of claim 1 wherein the V-shape comprises a first wall portion and a second wall portion, the first wall portion and the second wall portion angled relative to each other and meet at a common junction.

5. The wear element of claim 1, wherein the wear is made of a material selected from a group consisting of steel, a bronze magnesium alloy, and a copper alloy.

6. The wear element of claim 1, wherein the wear element is manufactured with a manufacturing process selected from a group consisting of casting, forging, machining, and additive manufacturing.

7. A mounting system for a blade of a motor grader, the mounting system comprising:

a mounting bracket having a mounting channel;

an adjustment block disposed in the mounting channel including a mounting groove extending along a longitudinal axis of the adjustment block; and a wear element having a dovetail portion configured to engage with the mounting groove of the adjustment block, and a V-shaped portion extending away from the dovetail portion and having a width at a distal end wider than the dovetail portion, the V-shaped portion configured to slidably receive a portion of the blade.

8. The mounting system of claim 7, wherein:

slidably receiving a portion of the blade includes the V-shaped portion slidably receiving a mounting rail of the blade.

9. The mounting system of claim 8, wherein the wear element is limited in a lateral movement by the mounting rail.

10. The mounting system of claim 8, wherein the wear element provides a sacrificial wear surface between the mounting rail of the blade and the adjustment block.

11. The mounting system of claim 7, wherein the mounting channel extends laterally along the adjustment block.

12. The mounting system of claim 7, wherein:

the adjustment block comprises a bore extending along a second lateral axis that intersects with the mounting groove, the bore being configured to receive a retention screw; and the retention screw is adapted to limit movement of the wear element along the longitudinal axis of the adjustment block.

13. The mounting system of claim 7, further comprising the mounting channel extending along a longitudinal axis of the mounting bracket.

14. The mounting system of claim 13, wherein a length of the wear element is greater than a length of the mounting bracket.

15. The mounting system of claim 13, further comprising a retention plate disposed on the mounting bracket, the retention plate adapted to engage with a slot provided on the adjustment block, wherein the retention plate is adapted to limit movement of the adjustment block along the longitudinal axis of the adjustment block.

* * * * *